US006196870B1

(12) United States Patent
Wu

(10) Patent No.: US 6,196,870 B1
(45) Date of Patent: Mar. 6, 2001

(54) BOARD LOCK

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/309,425

(22) Filed: May 11, 1999

(30) Foreign Application Priority Data

Oct. 6, 1998 (TW) ..... 87216521

(51) Int. Cl.[7] ..... H01R 13/66; H01R 13/73
(52) U.S. Cl. ..... 439/567; 439/571
(58) Field of Search ..... 439/567, 571, 439/607, 570, 572

(56) References Cited

U.S. PATENT DOCUMENTS 4,943,244 * 7/1990 Teck et al. ..... 439/567
5,085,589 * 2/1992 Kan ..... 439/92
5,407,364 * 4/1995 Tzeng et al. ..... 439/567

* cited by examiner

*Primary Examiner*—Brian Sircus
*Assistant Examiner*—Chandrika Prasad
(74) *Attorney, Agent, or Firm*—Wei Te Chung

(57) ABSTRACT

A board lock for securing an electrical connector to a circuit board includes a first panel positioned against the connector and a second panel spaced from the first panel. A fastener having an expanded end received between the first and second panels extends through a hole defined in the first panel and into a bore defined in the connector thereby securing the first panel of the board lock to the connector. A transverse panel extends from the second panel. The transverse panel has a smaller cross-sectional area than the second panel thereby enhancing the deformability of the transverse panel. A leg having barbs formed thereon is mounted to the transverse panel for inserting in and engaging with a hole defined in the circuit board. The leg defines a spatial relationship with respect to the first panel which is adjustable by means of the deformation of the transverse panel. The second panel may have an opening defined therein which reduces the cross-sectional area of the second panel, thus rendering the second panel to be more deformable. This helps the adjustment of the spatial relationship of the transverse panel with respect to the first panel.

11 Claims, 5 Drawing Sheets

BOARD LOCK

BACKGROUND OF THE INVENTION

1. Field of the Invention

The present invention relates to a board lock for securing an electrical connector to a circuit board.

2. The Prior Arts

Electrical connectors that connect an external device to a circuit board are usually fixed to the circuit board by means of soldering. To have the soldering operation properly carried out, the electrical connector has to be retained in position on the circuit board. This is commonly done by means of a board lock. Examples of board locks are disclosed in Taiwan patent application Nos. 78204719, 79203382 and 80213095. The conventional board lock comprises a base plate defining a hole therein for receiving a fastener. The fastener extends through and engages with a bore defined in the connector thereby securing the board lock to the connector. The conventional board lock further comprises a pair of spaced resilient legs. Each resilient leg has a barb for engaging with a hole defined in the circuit board thereby retaining the connector on the circuit board.

The conventional board lock is a fixed member which is generally incapable of adjustment to accommodate variation in the position of the hole of the circuit board.

In addition, the conventional board lock requires the connector to be completely located on or above the circuit board. This does not promote conservation of occupied spaced of the connector on the circuit board.

Hence, it is desirable to have a board lock that addresses the problems encountered in the prior art.

SUMMARY OF THE INVENTION

Accordingly, an object of the present invention is to provide a board lock for securing an electrical connector to a circuit board, the board lock comprising a leg inserted into and engaging with a hole defined in the circuit board, the leg defining an adjustable spatial relationship with respect to the connector thereby accommodating a positional variation of the hole of the circuit board.

Another object of the present invention is to provide a board lock for securing an electrical connector to a circuit board, wherein the board lock has a leg inserted into and engaging with a hole defined in the circuit board, the leg being supported by a deformable member which allows the spatial relationship between the leg and connector to be adjusted as desired.

A further object of the present invention is to provide an electrical connector comprising the board lock discussed above, wherein the spatial relationship between the leg and the connector is adjusted to allow the connector to be positioned against an edge of the circuit board with a portion thereof located below the circuit board, thereby reducing the space occupied by the connector above the circuit board.

To achieve the above objects, a board lock in accordance with the present invention comprises a first panel positioned against an electrical connector and a second panel spaced from the first panel. A fastener having an expanded end received between the first and second panels extends through a hole defined in the first panel and into a bore defined in the connector thereby securing the first panel of the board lock to the connector. A transverse panel extends from the second panel. The transverse panel has a smaller cross-sectional area than the second panel thereby enhancing the deformability of the transverse panel. A leg having barbs formed thereon is mounted to the transverse panel for inserting in and engaging with a hole defined in the circuit board. The leg defines a spatial relationship with respect to the first panel which is adjustable by means of the deformation of the transverse panel. The second panel may have an opening defined therein which reduces the cross-sectional area of the second panel, thus rendering the second panel to be more deformable. This facilitates the adjustment of the spatial relationship of the transverse panel with respect to the first panel.

In accordance with another aspect of the present invention, an electrical connector comprises a nonconductive casing having two bores defined therein, each having a board lock in accordance with the present invention associated therewith.

BRIEF DESCRIPTION OF THE DRAWINGS

The present invention will be apparent to those skilled in the art by reading the following description of the preferred embodiments thereof, with reference to the accompanying drawings, in which.

DETAILED DESCRIPTION OF THE PREFERRED EMBODIMENTS

Figure 1:
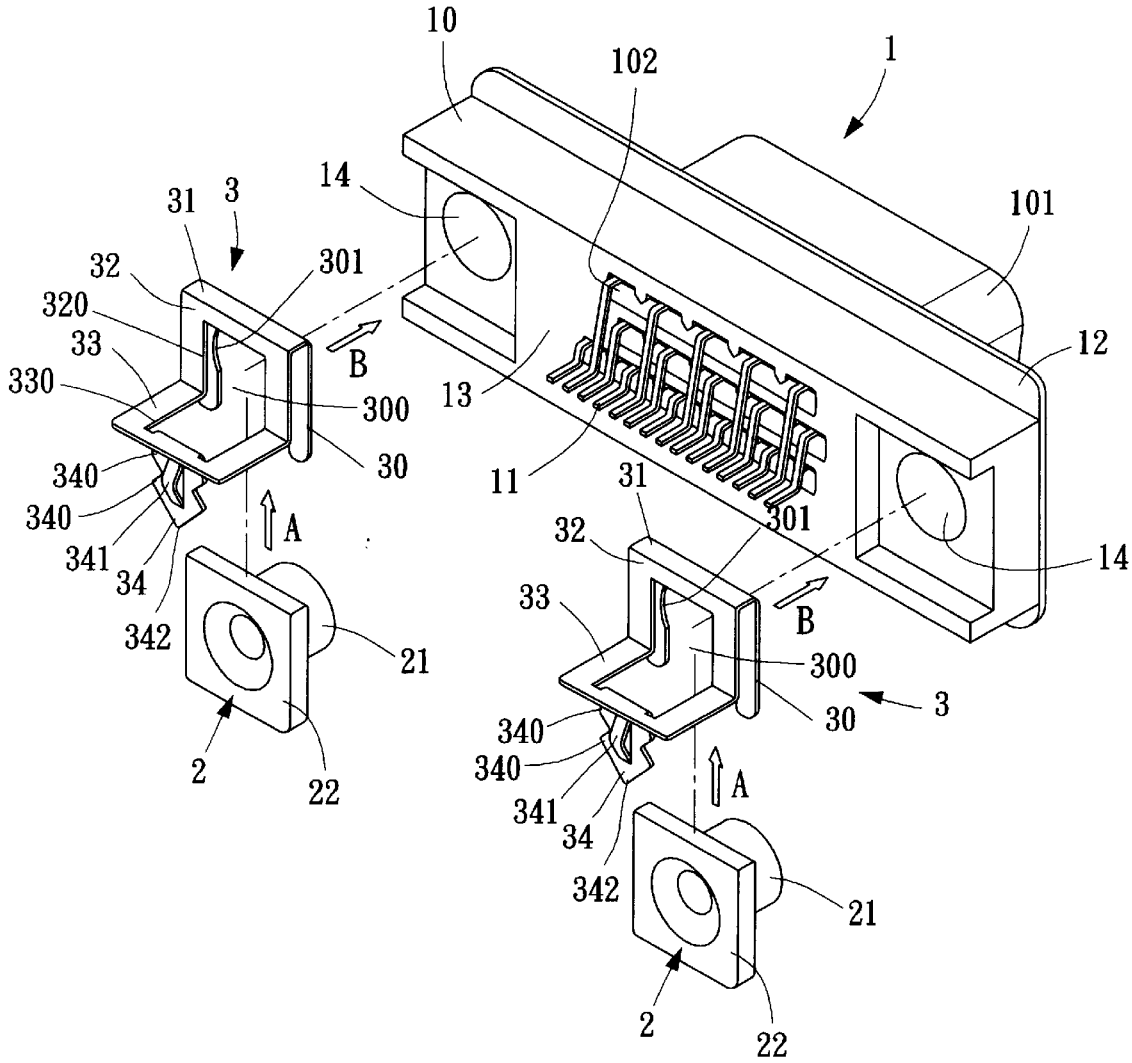
FIG. 1 in an exploded view of an electrical connector showing two board locks in accordance with the present invention to be mounted thereto.
Figure 2:
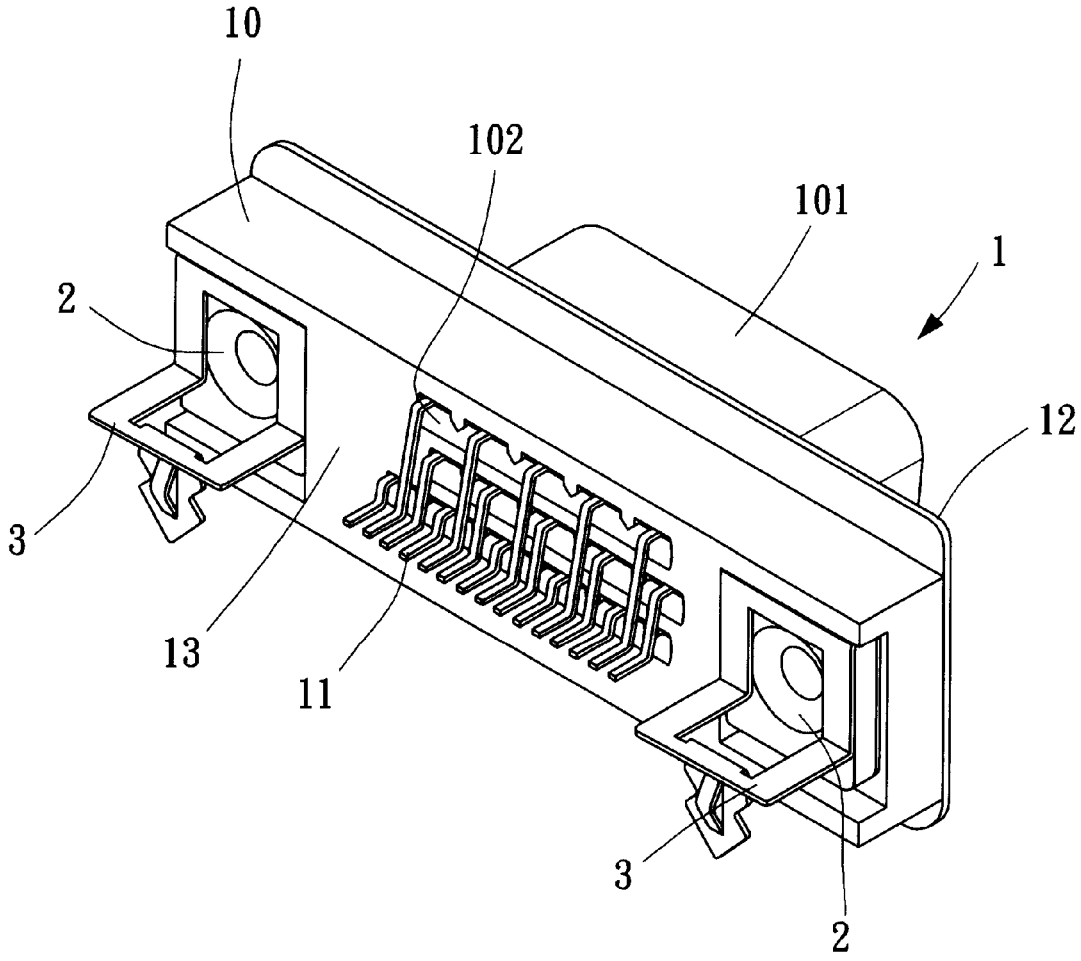
FIG. 2 is an assembled view of FIG. 1.

Referring to the drawings and in particular to FIGS. 1 and 2, two board locks 3 constructed in accordance with the present invention are mounted to an electrical connector 1. The connector 1 generally comprises a nonconductive casing 10 having a front face (not labeled) from which a mating projection 101 extends and a rear face 13 opposite the front face. A plurality of holes 102 are defined in the casing 10 between the front face and the rear face 13. The holes 102 are also defined through the mating projection 101 for receiving conductive pins 11 therein. A shielding member 12 is attached to the front face of the casing 10.

The casing 10 also defines two bores 14 between the front face and the rear face 13 proximate opposite ends of the casing 10.

Each board lock 3 comprises a first panel 30 and a second panel 32 which are opposite to and spaced from each other. A top panel 31 connects the first and second panels 30, 32 together to define a U-shaped member. The first panel 30 defines a central hole 301 therein. The hole 301 has a size substantially corresponding to the bore 14 of the casing 10. A slot 300 of a reduced width is defined in communication with the hole 301 and is exposed to an edge of the first panel 30 thus dividing the first panel 30 into two spaced segments. The first panel 30 is positioned against the rear face 13 of the casing 10 whereby the central hole 301 thereof aligns with the bore 14 of the casing 10.

Figure 3:
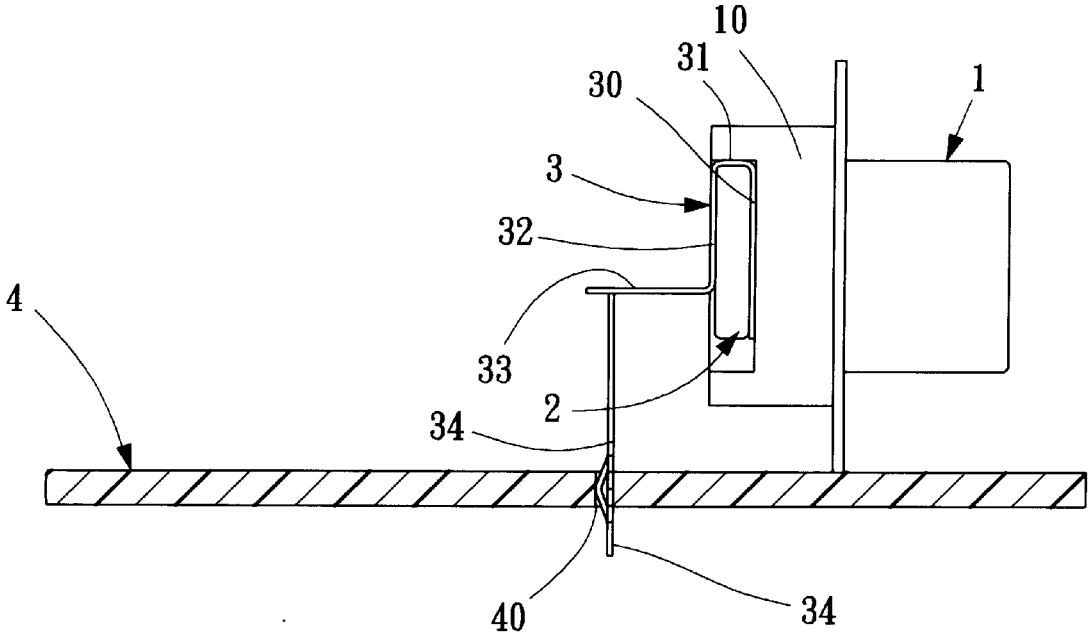
FIG. 3 is a side elevational view of the connector fixed to a circuit board by means of the board locks of the present invention.

A transverse panel 33 extends from the second panel 32, preferably from a lower free end thereof The transverse panel 33 defines an angle with respect to the second panel 32. Preferably the angle is 90 degrees as shown in FIG. 3, but may be changed if desired.

A leg 34 extends from the transverse panel 33. The leg 34 has barbs 340 formed on opposite edges thereof and a sharpened free end 342 which is formed by converging inclination of the two edges of the leg 34. The leg 34 further comprises a resilient raised section 341 formed on a surface thereof.

A fastener 2 comprises a cylindrical body 21 having an expanded end 22 and an opposite free end. The expanded end 22 has a thickness receivable in a space defined between the first and second panels 30, 32 of the board lock 3 with the cylindrical body 21 extending through the central hole 301 of the first panel 30. A free end of the cylindrical body 21 of the fastener 2 extends through the bore 14 of the casing 10 and secures the board lock 3 to the casing 10.

The cylindrical body 21 of the fastener 2 has a size substantially corresponding to the hole 301 of the first panel 30 and is slightly larger than the width of the slot 300 in order to securely retain the fastener 2 in the board lock 3. In this respect, the two segments of the first panel 30 are provided with resiliency whereby the segments of the first panel 30 are deformable to an extent that allows the cylindrical body 21 of the fastener 2 to pass through the slot 300 thereby receiving the expanded end 22 of the fastener 2 between the first and second panels 30, 32 as indicated by arrow A. The board lock 3 is then fixed to the casing 10 by inserting a portion of the cylindrical body 21 extending beyond the first panel 30 into the bore 14 of the casing 10 as indicated by arrow B.

The leg 34 defines a spatial relationship with respect to the first panel 30 and thus the connector 1 via the transverse panel 33 and the second panel 32. The transverse panel 33 is provided with an opening 330. The opening 330 reduces the cross-sectional area of the transverse panel 33 thereby enhancing the deformability thereof.

Preferably, the opening 330 of the transverse panel 33 is in communication with a cutout 320 defined in the second panel 32. The provision of the cutout 320 and the opening 330 reduces the material and weight of the second panel 32 and the transverse panel 33. Furthermore, the cutout 320 reduces the cross-sectional area and thus increases the deformability of the second panel 32. This is helpful in adjusting the spatial relationship of the leg 34 with respect to the first panel 30, including the position and orientation of the leg 34.

FIG. 3 shows an application of the board lock 3 of the present invention, wherein the board lock 3 secures an electrical connector 1 that is completely located above a substrate 4 to the substrate 4. The substrate 4 may be a printed circuit board or the like. The leg 34 of the board lock 3 extends downward into a hole 40 defined on the substrate 4. The leg 34 engages with the hole 40 by means of the barbs 340 and the resilient raised section 341.

Figure 4:
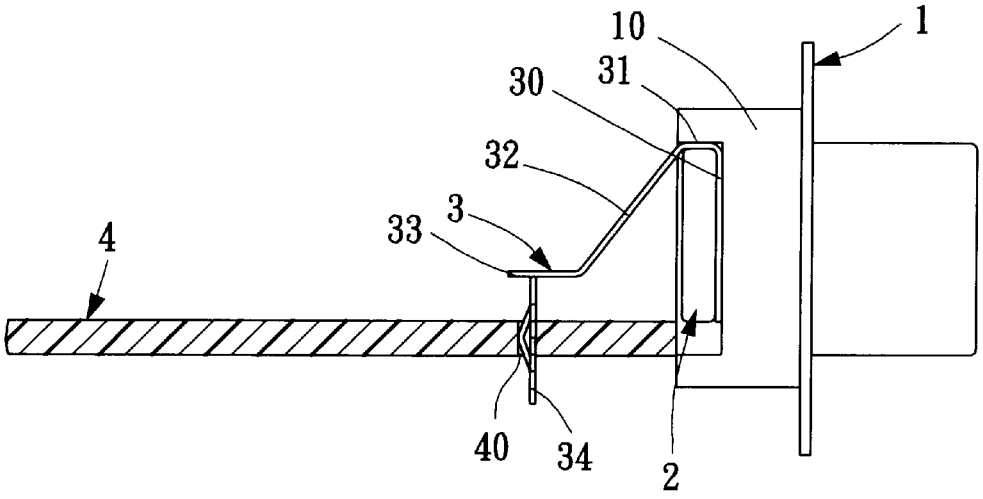
FIG. 4 is another a side elevational view of the connector fixed to a circuit board by means of the board locks of the present invention.

FIG. 4 shows another application of the board lock 3, wherein the board lock 3 secures a connector 1 that is positioned on an edge of the substrate 4 to the substrate 4. The second panel 32 may have a size or may be deformed to position the transverse panel 33 a distance from a bottom face of the connector 1 whereby only a portion of the connector 1 is located above the substrate 4. This reduces the space occupied by the connector 1 on the substrate 4. The deformability of the second panel 32 and the transverse panel 33 allows the position of the leg 34 to be readily adjusted with respect to the substrate 4 in order to accommodate the positional variation of the hole 40.

Figure 5:
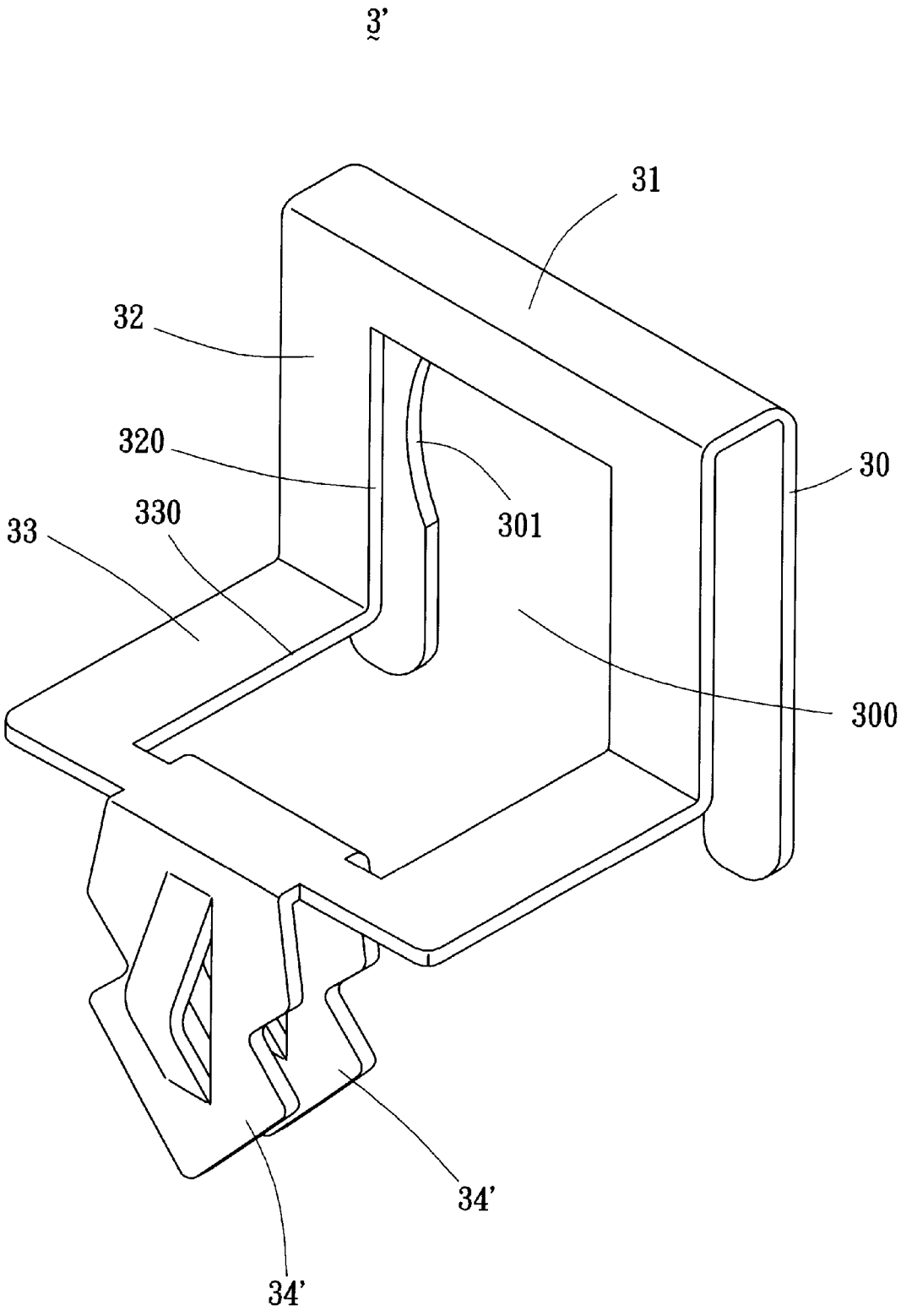
FIG. 5 is a perspective view of the board lock in accordance with a second embodiment of the present invention.

FIG. 5 shows a second embodiment of a board lock 3' in accordance with the present invention. The board lock 3' has a structure similar to the first embodiment, namely comprising a first panel 30 and a second panel 32 connected by a top panel 31. The first panel 30 defines a central hole 301 in communication with a slot 300 exposed to an edge of the first panel 30. A transverse panel 33 extends from the second panel 32. An opening 330 is defined in the transverse panel 33 and communicates with a cutout 320 defined in the second panel 32. However, the transverse panel 33 of the board lock 3' comprises two legs 34' which are spaced from each other and receivable in the hole 40 defined in the substrate 4. Each leg 34' has a construction similar to the leg 34 of the first embodiment.

Figure 6:
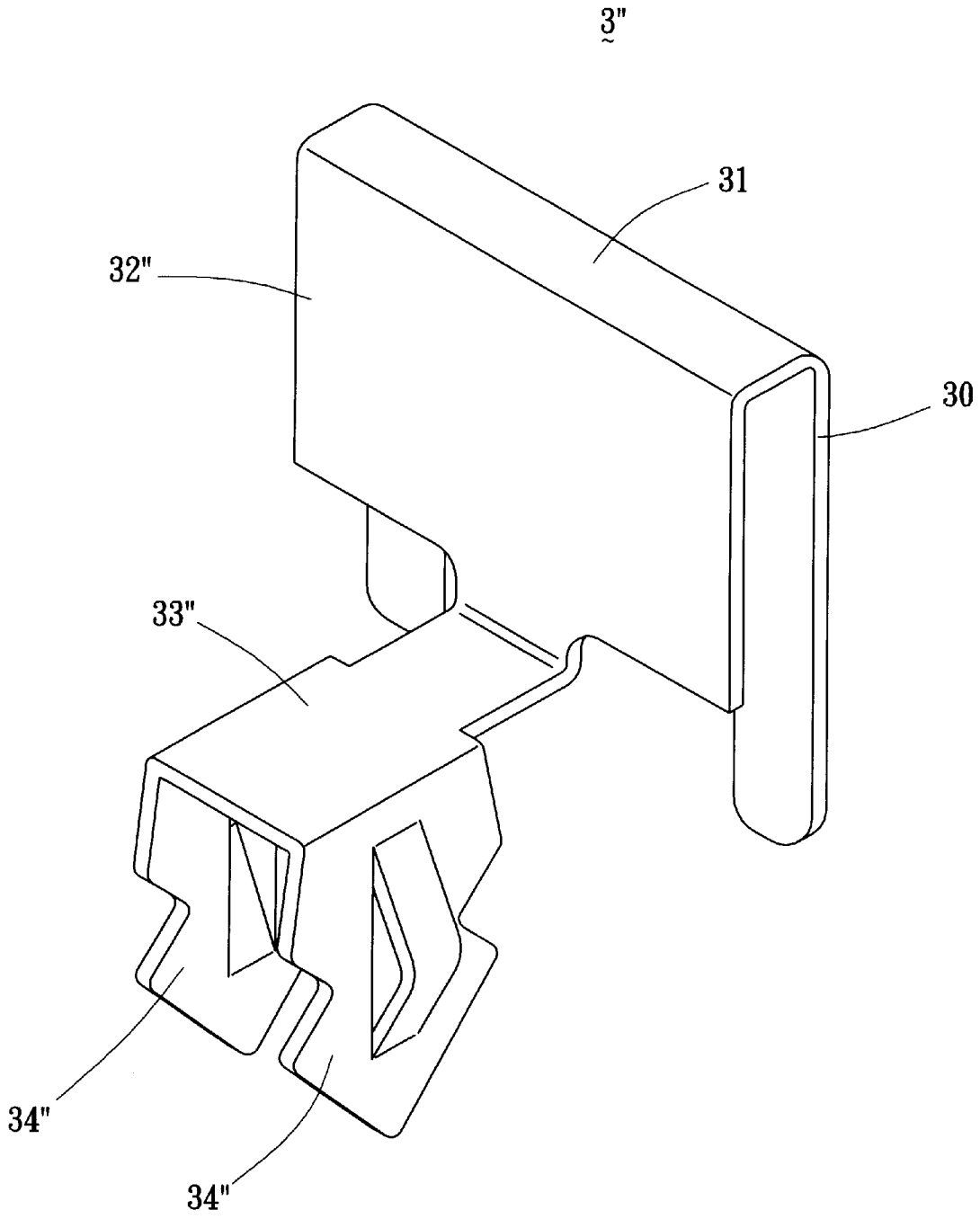
FIG. 6 is a perspective view of the board lock in accordance with a third embodiment of the present invention.

FIG. 6 shows a third embodiment of a board lock 3" in accordance with the present invention. The board lock 3" comprises a first panel 30 and a second panel 32" connected together by means of a top panel 31. The first panel 30 has a construction identical to the first and second embodiments and thus a detailed description thereof will be omitted herein. The second panel 32", however, is different from the second panel 32 of the first embodiment in that no opening is defined therein.

A transverse panel 33" extending from the second panel 32" has a smaller width and thus a smaller cross-sectional area than the second panel 32' for reducing the bending strength and torsional strength of the transverse panel 33" thereby enhancing the deformability thereof. Two legs 34" having a construction similar to the legs 34' of the second embodiment are formed at free end of the transverse panel 33". The legs 34", however, are oriented substantially normal to the second panel 32", while the legs 34, 34' of the first and second embodiments are substantially parallel to the second panels 32, 32' thereof Although the present invention has been described with reference to preferred embodiments thereof, it is apparent to those skilled in the art that a variety of modifications and changes may be made without departing from the scope of the present invention which is intended to be defined by the appended claims.

What is claimed is:

1. A board lock adapted to secure an electrical connector to a substrate, wherein the connector has a face, the board lock comprising:

a first panel adapted to be fixed to the face of the connector;

a second panel spaced from the first panel and a top panel connecting the second panel to the first panel thereby defining a space therebetween for receiving an expanded end of a fastener for securing the board lock to the electrical connector, the second panel having a predetermined overall width and a predetermined cross-sectional area associated therewith;

a transverse panel extending at a defined angle from the second panel, the transverse panel having a cross-sectional area smaller than the cross-sectional area of the first panel, thereby providing the transverse panel with a greater deformability than the first panel; and at least one leg extending from the transverse panel, comprising hole engaging means formed thereon adapted to be inserted in and engage with a hole defined in the substrate, the leg having a spatial relationship with respect to the first panel by means of the transverse panel;

wherein the deformability of the transverse panel allows the spatial relationship of the leg with respect to the second panel to be adjustable for accommodating a positional variation of the hole of the substrate with respect to the connector.

2. The board lock as claimed in claim 1, wherein the hole engaging means of the leg comprises barbs formed on edges of the leg for engaging with the hole of the substrate.

3. The board lock as claimed in claim 1, wherein the hole engaging means of the leg comprises a resilient raised section formed on a face of the leg for engaging with the hole of the substrate.

4. The board lock as claimed in claim 1, wherein the transverse panel has a width substantially corresponding to the overall width of the second panel, an opening being defined in the transverse panel which reduces the cross-sectional area of the transverse panel.

5. The board lock as claimed in claim 4, wherein the opening of the transverse panel is further defined in a first portion of the second panel thereby reducing the cross-sectional area of the first portion of the second panel, thus rendering the first portion of the second panel to be more deformable.

6. The board lock as claimed in claim 1, wherein the transverse panel has a width smaller than the overall width of the second panel whereby the cross-sectional area of the transverse panel is smaller than the cross-sectional area of the second panel.

7. The board lock as claimed in claim 1, wherein the board lock comprises two legs extending from the transverse panel.

8. The board lock as claimed in claim 2, wherein the connector defines a bore in the face thereof and wherein the first panel defines a hole therein corresponding in position and size to the bore of the connector, the fastener being received in the space defined between the first and second panels and extending through the bore of the connector and the hole of the first panel to secure the first panel to the connector.

9. The board lock as claimed in claim 8, wherein the first panel defines a slot in communication with the hole and exposed to an edge thereof, the slot having a width smaller than the hole and dividing the first panel into two segments which are resilient and undergo deformation when receiving the fastener into the hole.

10. An electrical connector adapted to be mounted to a substrate comprising:

a nonconductive casing having a face on which a plurality of holes are defined to receive conductive pins therein; and at least one board lock fixed to the face of the casing, the board lock comprising:

a first panel fixed to the face of the connector, the first panel having a predetermined overall width and a predetermined cross-sectional area associated therewith;

a second panel spaced from the first panel and a top panel connecting the second panel to the first panel thereby defining a space therebetween for receiving an expanded end of a fastener for securing the board lock to the electrical connector, the second panel having a predetermined overall width and a predetermined cross-sectional area associated therewith;

a transverse panel extending from the second panel, the transverse panel having a cross-sectional area smaller than the cross-sectional area of the first panel, thereby providing the transverse panel with a greater deformability than the first panel; and at least one leg extending from the transverse panel, comprising hole engaging means formed thereon adapted to be inserted in and engage with a hole defined in the substrate, thereby securing the connector to the substrate, the leg having a spatial relationship with respect to the first panel by means of the transverse panel;

wherein the deformability of the transverse panel allows the spatial relationship of the leg with respect to the first panel to be adjustable for accommodating a positional variation of the hole of the substrate with respect to the connector.

11. A board lock adapted to secure an electrical connector to a substrate, comprising:

a base panel including a vertical first panel and a vertical second panel spaced from each other in a parallel relation to define a downwardly facing channel therebetween for receiving a fastener therein, and connected with each other by a top panel, a transverse panel extending rearward from a bottom edge of said second panel and perpendicular to one of said first and second panels;

at least one leg extending downward from and perpendicular to the transverse panel; wherein said leg is parallel to both said first and second panels.

* * * * *